US009338555B1

(12) United States Patent
Oxford

(10) Patent No.: US 9,338,555 B1
(45) Date of Patent: May 10, 2016

(54) EARPHONES AND HEARING AIDS WITH EQUALIZATION

(76) Inventor: J. Craig Oxford, Nashville, TN (US)

( * ) Notice: Subject to any disclaimer, the term of this patent is extended or adjusted under 35 U.S.C. 154(b) by 137 days.

(21) Appl. No.: 13/398,782

(22) Filed: Feb. 16, 2012

Related U.S. Application Data

(60) Provisional application No. 61/443,387, filed on Feb. 16, 2011, provisional application No. 61/578,727, filed on Dec. 21, 2011.

(51) Int. Cl.
*H04R 1/10* (2006.01)
*H04R 5/04* (2006.01)
*H04R 5/033* (2006.01)

(52) U.S. Cl.
CPC . *H04R 5/033* (2013.01); *H04R 5/04* (2013.01)

(58) Field of Classification Search
CPC ..... H04R 5/033; H04R 5/04; H04R 1/1041; H04R 1/1016; H04R 2420/07
USPC ..... 381/74
See application file for complete search history.

(56) References Cited

U.S. PATENT DOCUMENTS 4,596,902 A * 6/1986 Gilman ..... 381/320
5,105,822 A * 4/1992 Stevens ..... A61B 5/12 600/559
5,125,032 A * 6/1992 Meister et al. ..... 381/72
6,813,490 B1 * 11/2004 Lang ..... H04M 1/72563 204/221
6,885,752 B1 * 4/2005 Chabries ..... H03G 9/005 381/106
7,671,694 B2 * 3/2010 Yeung et al. ..... 333/28 R
8,532,320 B2 * 9/2013 Nordahn et al. ..... 381/321
2006/0140418 A1 * 6/2006 Koh ..... H04R 25/70 381/98
2008/0031477 A1 * 2/2008 Von Buol ..... H04R 25/405 381/313
2008/0130910 A1 * 6/2008 Jobling et al. ..... 381/74
2009/0074197 A1 * 3/2009 Neher et al. ..... 381/60
2010/0195856 A1 * 8/2010 Grafenberg et al. ..... 381/317

* cited by examiner

*Primary Examiner* — Simon Sing
(74) *Attorney, Agent, or Firm* — Wayne Edward Ramage; Baker Donelson

(57) ABSTRACT

A system, methods, and devices that allow a listener to compensate for variability in the physical configuration and characteristics of individual ears to optimize the sound quality and listening experience for sound reproduction or amplification through an earphone, earbud, hearing aid, or the like. The present invention comprises one or more earphones, earbuds, hearing aid, dongle, or similar devices with an equalizer or equalizing circuitry or processing program contained therein, or in a circuit with the earphone, earbud, hearing aid or similar device. The equalizer or equalizing circuitry or processing program may be located in a separate device attached or in electronic communication, wired or wirelessly, to the earphone, earbuds or hearing aid, such as a remote. It also may be located in the sound-providing or music-providing device. The equalizer settings can be adjusted manually or automatically for each ear. An amplifier, or amplifying circuitry, also may be present.

10 Claims, 10 Drawing Sheets

EARPHONES AND HEARING AIDS WITH EQUALIZATION

This application claims benefit of and priority to U.S. Provisional Applications No. 61/443,387, filed Feb. 16, 2011, by J. Craig Oxford, and No. 61/578,727, filed Dec. 21, 2011, by J. Craig Oxford, and is entitled to those filing dates for priority. The specifications, figures and complete disclosures of U.S. Provisional Applications Nos. 61/443,387 and 61/578,727 are incorporated herein by specific reference for all purposes.

FIELD OF INVENTION

This invention relates to earphones and hearing aids. More particularly, this invention relates to earphones and hearing aids adapted to enhance audio quality through processing of the audio signal.

BACKGROUND OF THE INVENTION

The use of earphones, also known as "earbuds," and in-ear headphones has been proliferating. Examples of earphones are disclosed in Iseberg et al, U.S. RE40,696, and Blanchard, U.S. Pat. No. 7,681,577, both of which are incorporated herein by specific reference for all purposes. Similarly, the use of hearing aids also is increasing with the aging of the population. Examples of hearing aids and associated processing methods are disclosed in U.S. Pat. Nos. 5,016,280; 5,259,033; 5,621,802; and 7,197,152; all of which are incorporated herein by specific reference for all purposes.

Each ear is a unique sound chamber with its own configuration and characteristics and a standard earphone or hearing aid that provides adequate sound quality for one ear may not do so for another ear, even on the same individual. The same is true for standard, or "external" headphones or headsets Most headphones, ear buds, hearing aids and the like are created with a normative head model so as to fit most users, with a number of limiting factors thereby reducing sound quality and the listening experience. While a user can chose among earphones or hearing aids with a wide variety of colors and other aesthetic elements, and some variability in quality of components, and thus quality of sound reproduction, there is no means for a user to adjust a particular set of earphones or hearing aids based on the physical characteristics of each particular ear.

Accordingly, what is needed is a device, system and method for adjusting sound quality and characteristics based on individual ear characteristics.

SUMMARY OF INVENTION

In various embodiments, the present invention comprises a system, methods, and devices that allow a listener to compensate for variability in the physical configuration and characteristics of individual ears to optimize the sound quality and listening experience for sound reproduction or amplification through an earphone, earbud, hearing aid, or the like.

In several exemplary embodiments, the present invention comprises one or more earphones, earbuds, hearing aid, dongle, or similar devices with an equalizer or equalizing circuitry or processing program contained therein, or in a circuit with the earphone, earbud, hearing aid or similar device. In one exemplary embodiment, the equalizer or equalizing circuitry or processing program may be located in a separate device attached or in electronic communication, wired or wirelessly, to the earphone, earbuds or hearing aid, such as a remote. It also may be located in the sound-providing or music-providing device, such as an iPod, iTouch, mp3 player, cell phone, or similar device, as an computer program or application. The equalizer settings can be adjusted manually or automatically for each ear.

In another exemplary embodiment, an amplifier, or amplifying circuitry, also may be present. The amplifier may be external or inline, and provides more power to the speakers in the headphones, earbuds, or similar devices independent from an audio device's power source (such as, for example, a portable audio device like an iPod, mp3 player, or similar device). The amplifier also may be contained in the earphone, earbud, or hearing aid itself.

Power may be supplied through a connection with an external device (such as an iPod, mp3 player, cell phone, or similar device), or alternatively, may be a separate battery or power supply. The battery or power source may be internal to the earphone itself, or one earphone in a pair, or may be separate from the earphone and electrically connected thereto.

The amplifier and equalizer may be contained in the same device or pack, or separate. The equalizer may provide equalization of the signal from the source prior to amplification by the amplifier and final production of sound through the earphones. In an alternative configuration, amplification may take place prior to equalization.

In one particular embodiment, the amplifier is a 1000 mW amplifier, and the power source is a 5 volt battery.

It should be noted that the devices and methods described herein are applied to hearing aids in the same manner as earbuds or earphones. In this embodiment, the equalization is adjusted for the individual ear to compensate for hearing loss and to correct for hearing deficiencies or anomalies. The processing described herein re-introduces the emotion component to the sound heard by the user to stimulate arousal of the limbic system response, which is not present in hearing aids now known in the art. It may also be adjusted to compensate for ambient noise or noisy environments, thereby avoiding the problem of the hearing aid shutting down, for example, when ambient white noise exceeds 65 db.

The equalization can be done manually, automatically, or semi-automatically. In one embodiment, the equalizer may actively adjust itself by sending an acoustic or sound signal into the ear, receive and read the reflection, and automatically adjust itself based upon the reflection. In one example, test tones with known parameters are played, and a microphone embedded or placed in the device or ear canal listens to the sound within the ear canal. The data is fed into a real-time spectrum analyzer which measures the returned sound and compares it to the original sound. The differences are sent to the equalizer, which compensates for the differences to result in an individualized equalizer setting. Thus, each earbud or hearing aid may be individually adjusted for a particular ear, and a user may have different equalization or adjustments for each ear. Adjustments may be made for hearing loss or other anomalies.

In yet another embodiment, a separate device may be used to conduct the reflection measurements for each ear to determine the ear-canal characteristics. Alternatively, as described above, a series of tones may be played to calibrate each earbud, earphone or hearing aid (the tones may be played on a cell phone or smart phone as a computer or application program, for example, with the earbuds, earphones or hearing aids plugged in). The equalization may be adjusted, or alternatively, a particular earbud, hearing aid or earphone of a particular configuration may then be selected for each ear based on these measurement. The earbud, hearing aid or earphone may be one of various standard configurations from which to choose. A user may thus have a set of earbuds, hearing aids or earphones where the individual device is configured differently for each ear.

In another embodiment, a user may be able to make adjustments to the equalizer directly, either through controls on or attached to the earphone, or through a computer interface or device to which the earphone is connected (e.g., the earphone is plugged into a jack on the computer or device, and a program or application on the computer or device is used to make the adjustments). Thus, the user can customize or modify the audio output from that individual earphone to suit the desire of the user, compensate for hearing loss or anomalies, or the like. Each earbud may be individually adjusted for a particular ear, and a user may have different equalization or adjustments for his or her ears.

One exemplary method of manually adjusting equalizer settings for an earbud or earbuds (or similar devices) comprises a basic psychophysical method of measuring the user's threshold of hearing which is then used to set an individualized equalizer for the person with that particular set of headphones, earbuds, earphones, hearing aids, or the like, thereby obtaining the listener's unique frequency response curve. The user initiates the process by starting up the configuration program or application (which may be available as a program or "app" on a smart phone, tablet computer, portable music device, or similar device). Alternatively, the process may be initiated through a control on an inline dongle, or the like. The program or application using an adaptive method to determine the user's threshold of hearing. The program starts by playing a set frequency through one of the earbuds, earphones, or hearing aids, each frequency starting at a low intensity and gradually increasing until the user responds (such as by a button or key press) to indicate that he or she has heard the signal. At that point, the program decreases the intensity of the signal until the user stops indicating that they can hear the signal. These steps can be repeated several times for the same frequency to determine a mean (or average) intensity for that frequency for that particular ear. The process then is repeated at a different set frequency so as to eventually cover a range of frequency bands (i.e., center frequencies of the octave) for that ear. The entire process is then repeated for the other ear. It should be noted that the frequencies tested may be in different orders, and that testing of frequencies can alternate between ears. The difference between the means (or averages) for the frequency bands is then used to set the equalizer for the frequency bands so as to the optimize the frequency response for the individual listener for that particular set of headphones, earbuds, earphones, or hearing aids.

This individualized equalizer setting is saved for the user as a baseline setting. The user can subsequently modify this baseline setting in accordance with a number of preset modifications (e.g., rock, jazz, R&B, classical, and the like). In one embodiment, these preset modifications do not result in preset configurations that are identical for all users, but are preset modifications made to the individual's baseline setting, with the modifications made in accordance with the preset type. Thus, an individual's "rock" equalization setting for their left earbud may differ from the "rock" setting for their right earbud, and will differ from another individual's "rock" settings.

These functions may be encompassed in a single program or application operable on a smart phone, tablet, or other similar device as described above. The program can run the configuration program to set individualized equalizer settings as described above. The user can separately load these settings, and apply preset setting modifications and/or list settings for review and application. The user also may manually modify the baseline equalizer setting, or any of other settings through a graphic equalizer on the device screen, and save those modified settings.

In another embodiment, the equalizer may have a number of established settings that can be chosen. The use may choose a desired setting for each earbud by a switch or controls on or attached to the earphone, or through a computer interface or device to which the earphone is connected (e.g., the earphone is plugged into a jack on the computer or device). Alternatively, where the equalizer actively adjusts itself as described above, it (or its control program or application) may automatically choose one of these settings based upon the reflection, rather than independently adjust particular bands.

In one embodiment, a pair of earphones may be provided as part of a set. Each earphone may have its own equalizer that can be individually adjusted. In another embodiment, a single equalizer may be used to adjust each of the earphones, but still separately (i.e., the user can switch between the right and left earphone while using the same equalizer control). In yet another embodiment, a single equalizer is used and those settings are used for both earphones. Where hearing aids or devices with a microphone are used, this permits the listener to receive the aural input and filter out white noise and other interfering frequencies and sounds (i.e., the device determines and compensates for ambient noise).

In yet another embodiment, earphones or hearing aids may be produced with preset equalizer settings for a particular type or configuration of ear. The user then purchases the appropriate earphone for his or her type (or types) of ear, but cannot adjust the equalizer setting.

A further embodiment comprises one or more microphones attached to or embedded in the earphones, earphones or hearing aids. The microphones enhance speech and can be used to filter environmental noise. An inline microphone or microphones (i.e., a microphone on a control dongle in electronic communication with the earphones) can be used as directional microphones to enhance hearing from a particular source, to talk on a mobile phone, or the like. While a single microphone may be used, multiple microphones may be used to enhance sound localization in the free field.

In yet another embodiment, the earbuds, earphones or hearing aids as described above are used as part of a hearing telecoil or inductive loop. Such loops are known in the prior art in public spaces, and the present invention can be adapted to pick up such transmissions. Loops can also be installed in private spaces, such as homes, automobiles, restaurants, bars, stores, and the like. In one embodiment, a loop may be made from the wires in the earphone or device cables.

In one embodiment an inductive loop receiver is connected to the earphone amplifier. The inductive loop receiver receives the audio signal from an inductive loop, such as a commercial inductive loop in a commercial area. The amplifier is connected to a radio frequency (RF) transmitter and receiver with a microphone. The microphone in conjunction with the RF transmitter allows the transmission of local speech to a matching radio frequency receiver located at the inductive loop system transmitter, which in turn broadcasts said speed via the inductive loop system to all individuals in range who are equipped with the system. This allows individuals so equipped to talk to other individuals directly, using the RF receiver and transmitter as a two-way communication system. The microphone may be a highly-direction type of microphone in order to allow it to be aimed at a particular sound source, thereby improving intelligibility in noisy environments and reducing unwanted background noises. This is especially useful when using the system as a hearing aid.

Controls for the present invention may be contained in a smart phone device, in a dongle or similar apparatus connected to the earbuds or hearing aids, or in the device cables. Controls also may be wireless. In one embodiment, a user may switch between several input sources: e.g., the environment (as a hearing aid); a stereo or music source; a public loop; or other loops, in areas with multiple loops. In one embodiment, when used in conjunction with a microphone for the user, a number of individuals using the device can talk and listen to each other in a bar, club, stadium, arena, auditorium, classroom, movie theatre, or other space on a private loop, where the loop is created and maintained by their devices (i.e., a form of voice instant messaging).

In yet a further embodiment, pairs of earphones may be provided with processing circuitry or a program to create a three-dimensional or stereotactic effect, or other effects. In one embodiment, the processing involves the introduction of a time-delayed dither between two or more earphones, thereby simulating movement of the head during the listening process. The time-delay can be adjusted. In one exemplary embodiment, the processing provides both "near" and "far" settings, to simulate, for example, a sound source from within a room and from outside a room.

In another embodiment, the circuitry creates numerous, fast, saccadic shifts in the frequency of the signal to create a mental, three-dimensional effect in the sound. This is similar to the saccadic movement of human eyes. Humans, as well as many other animals, do not look at a visual scene in fixed steadiness. Instead, their eyes move around, locating noteworthy or interesting parts of the scene, thereby building up a mental, three-dimensional "map" corresponding to the visual scene. The movement of the eye allows smaller parts of a visual scene to be sensed with greater resolution. Saccades are the fastest movements produced by the human body. Saccades in response to an unexpected stimulus usually take approximately 200 milliseconds (ms) to initiate, and then last from about 20 to 200 ms, depending on their amplitude. Saccades during language reading typically last 20-30 ms.

In yet another embodiment, the earbuds or hearing aids may further comprise a variety of signal filters. In one embodiment, the filter is an apodizing filter to eliminate pre-echo or pre-ringing.

The above elements also may be applied to a set of external headphones or other hearing apparatus, with separate equalization and/or filtering and/or effect creation for each ear. Such a set of headphones provides more room to encompass the amplifier, equalizer, and/or power source.

It also should be noted that the above-described amplification, equalization, saccadic effect, and other processing can be performed on both digital and analog signals. The equalization and other techniques described above also may be applied to loudspeakers in music systems, home theatre systems, televisions, computers, and other devices.

DETAILED DESCRIPTION OF EXEMPLARY EMBODIMENTS

Figure 1:
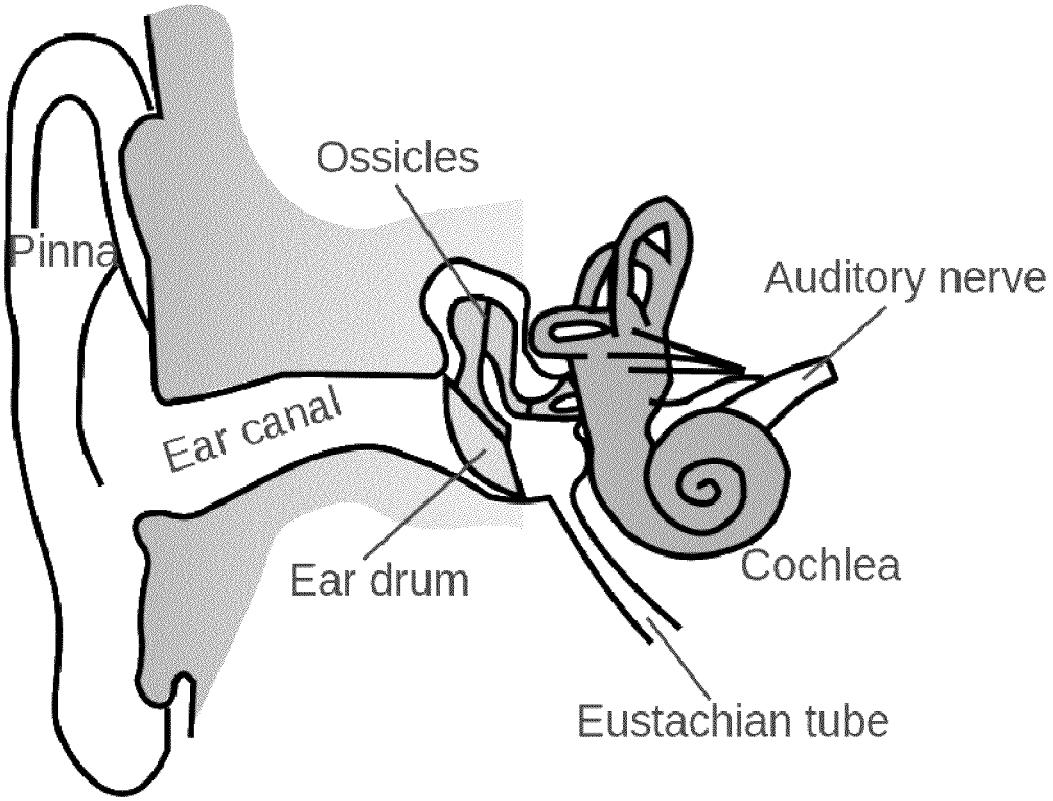
FIG. 1 shows a view of the interior configuration of a typical human ear.

In various embodiments, the present invention comprises a system, methods, and devices that allows a listener to compensate for variability in the physical configuration and characteristics of individual ears to optimize the sound quality and listening experience for sound reproduction or amplification through an earphone, earbud, hearing aid, or the like. Each ear is a unique sound chamber with its own anatomical configuration and characteristics (as seen in FIG. 1), and a standard earphone or hearing aid that provides adequate sound quality for one ear may not do so for another ear, even on the same individual. For example, the size and shape of the pinna, and length and width of the ear canal, can vary greater from person to person, and even from ear to ear on the same individual. The size and shape of these features filters, amplifies, and changes the sound impacting the ear drum.

In addition, the listening experience can differ from one individual to another as a result of the different effects from different frequencies on the individual. Further, a person has a unique equal-loudness contour or audiogram of how he or she perceives the sound. These differences are further compounded by the fact that each set of headphones, earbud, earphones, or hearing aids have a unique frequency response curve. The combination of some or all of these factor together can drastically change or deteriorate the sound quality and perception of sounds.

In several exemplary embodiments, the present invention comprises one or more earphones, earbuds, hearing aid, dongle, or similar devices with an equalizer or equalizing circuitry or processing program contained therein, or in a circuit with the earphone, earbud, hearing aid or similar device. In one exemplary embodiment, the equalizer or equalizing circuitry or processing program may be located in a separate device attached or in electronic communication, wired or wirelessly, to the earphone, earbuds or hearing aid, such as a remote. It also may be located in the sound-providing or music-providing device, such as an iPod, iTouch, mp3 player, cell phone, or similar device, as an computer program or application. The equalizer settings can be adjusted manually or automatically for each ear.

Figure 2:
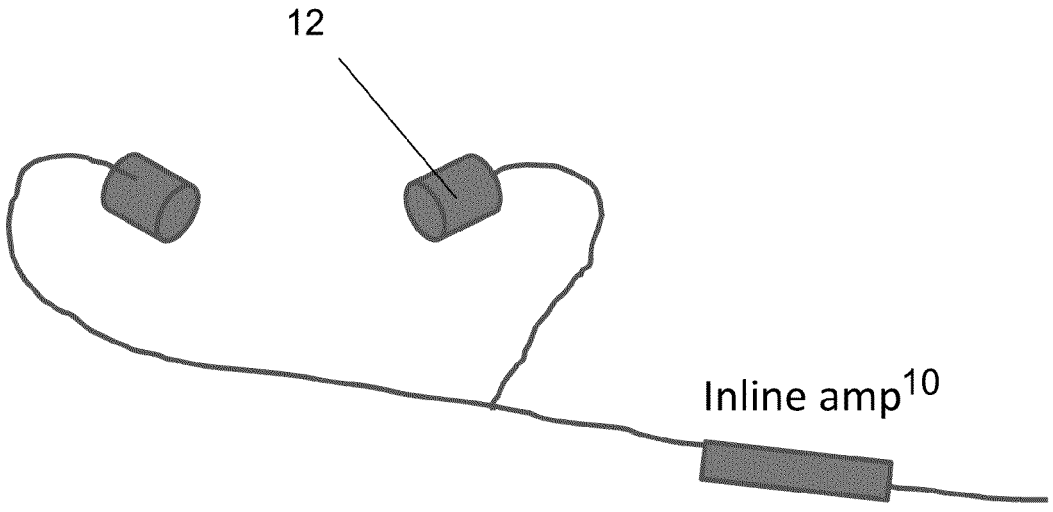
FIG. 2 shows a view of an earphone or hearing aid in accordance with an embodiment of the present invention.
Figure 3:
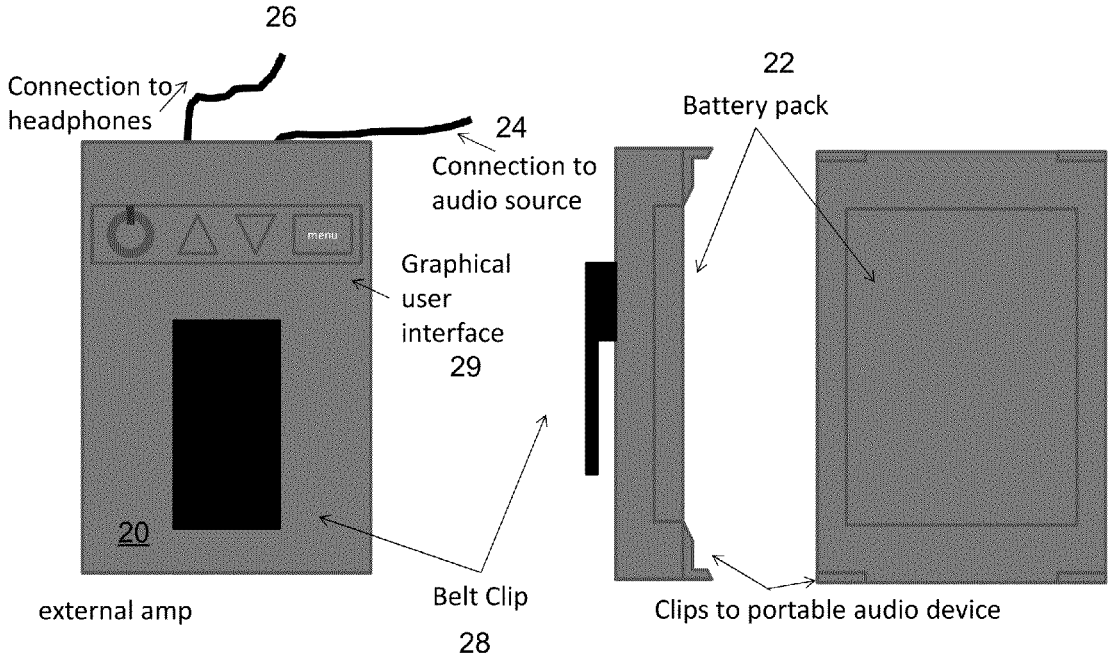
FIG. 3 shows a view of an earphone or hearing aid in accordance with another embodiment of the present invention.

In another exemplary embodiment, an amplifier, or amplifying circuitry, also may be present. The amplifier may be external or inline, as seen in FIGS. 2 and 3, and provides more power to the speakers in the headphones, earbuds, or similar devices independent from an audio device's power source (such as, for example, a portable audio device like an iPod, mp3 player, or similar device). The amplifier also may be contained in the earphone, earbud, or hearing aid itself.

FIG. 2 shows an example of an amplifier 10 as an inline device with in electronic communication with earbuds 12. Power may be supplied through a connection with an external device (such as an iPod, mp3 player, cell phone, or similar device), or alternatively, may be a separate battery or power supply. The battery or power source may be internal to the earphone itself, or one earphone in a pair, or may be separate from the earphone and electrically connected thereto.

FIG. 3 shows an example of an external amplifier 20 that is removably attached or clipped to a portable audio device, with its own separate battery pack 22. The external amplifier connects 24 to the portable audio device (or other audio source) and connects 26 to the headphones or earbuds via a plug or other means known in the art. Controls are accessible through a graphical user interface 29. The external amplifier also may comprise a belt clip 28 or similar means to attach to a belt, strap, or the like.

Figure 4:
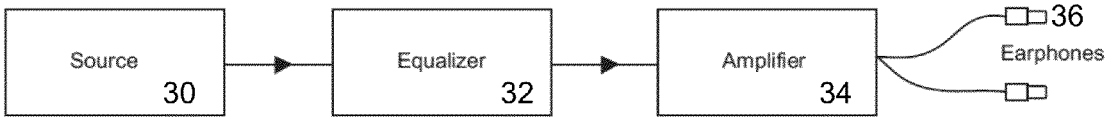
FIG. 4 shows a diagram of a frequency response equalization system in accordance with an exemplary embodiment of the present invention.

The amplifier and equalizer may be contained in the same device or pack, or separate. As shown in FIG. 4, the equalizer 32 may provide equalization of the signal from the source 30 prior to amplification by the amplifier 34 and final production of sound through the earphones 36. In an alternative configuration, amplification may take place prior to equalization.

In one particular embodiment, the amplifier is a 1000 mW amplifier, and the power source is a 5 volt battery.

It should be noted that the devices and methods described herein are applied to hearing aids in the same manner as earbuds or earphones. In this embodiment, the equalization is adjusted for the individual ear to compensate for hearing loss and to correct for hearing deficiencies or anomalies. The processing described herein re-introduces the emotion component to the sound heard by the user to stimulate arousal of the limbic system response, which is not present in hearing aids now known in the art. It may also be adjusted to compensate for ambient noise or noisy environments, thereby avoiding the problem of the hearing aid shutting down, for example, when ambient white noise exceeds 65 db.

Figure 5:
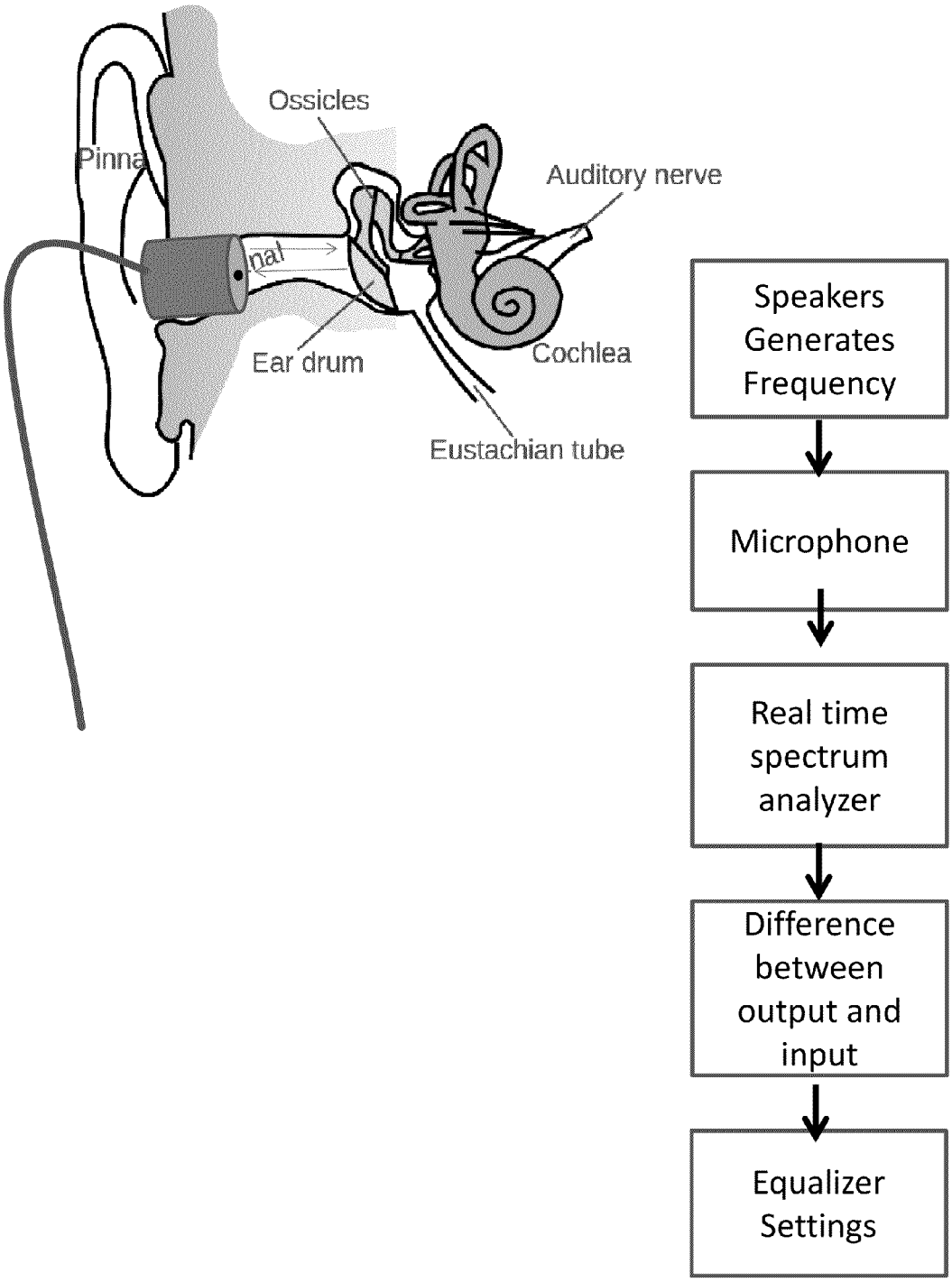
FIG. 5 shows a view of an earphone or hearing aid in accordance with another embodiment of the present invention.

The equalization can be done manually, automatically, or semi-automatically. In one embodiment, as seen in FIG. 5, the equalizer may actively adjust itself by sending an acoustic or sound signal into the ear, receive and read the reflection, and automatically adjust itself based upon the reflection. In one example, test tones with known parameters are played, and a microphone embedded or placed in the device or ear canal listens to the sound within the ear canal. The data is fed into a real-time spectrum analyzer which measures the returned sound and compares it to the original sound. The differences are sent to the equalizer, which compensates for the differences to result in an individualized equalizer setting. Thus, each earbud or hearing aid may be individually adjusted for a particular ear, and a user may have different equalization or adjustments for each ear. Adjustments may be made for hearing loss or other anomalies.

In yet another embodiment, a separate device may be used to conduct the reflection measurements for each ear to determine the ear-canal characteristics. Alternatively, as described above, a series of tones may be played to calibrate each earbud, earphone or hearing aid (the tones may be played on a cell phone or smart phone as a computer or application program, for example, with the earbuds, earphones or hearing aids plugged in). The equalization may be adjusted, or alternatively, a particular earbud, hearing aid or earphone of a particular configuration may then be selected for each ear based on these measurement. The earbud, hearing aid or earphone may be one of various standard configurations from which to choose. A user may thus have a set of earbuds, hearing aids or earphones where the individual device is configured differently for each ear.

In another embodiment, a user may be able to make adjustments to the equalizer directly, either through controls on or attached to the earphone, or through a computer interface or device to which the earphone is connected (e.g., the earphone is plugged into a jack on the computer or device, and a program or application on the computer or device is used to make the adjustments). Thus, the user can customize or modify the audio output from that individual earphone to suit the desire of the user, compensate for hearing loss or anomalies, or the like. Each earbud may be individually adjusted for a particular ear, and a user may have different equalization or adjustments for his or her ears.

Figure 6:
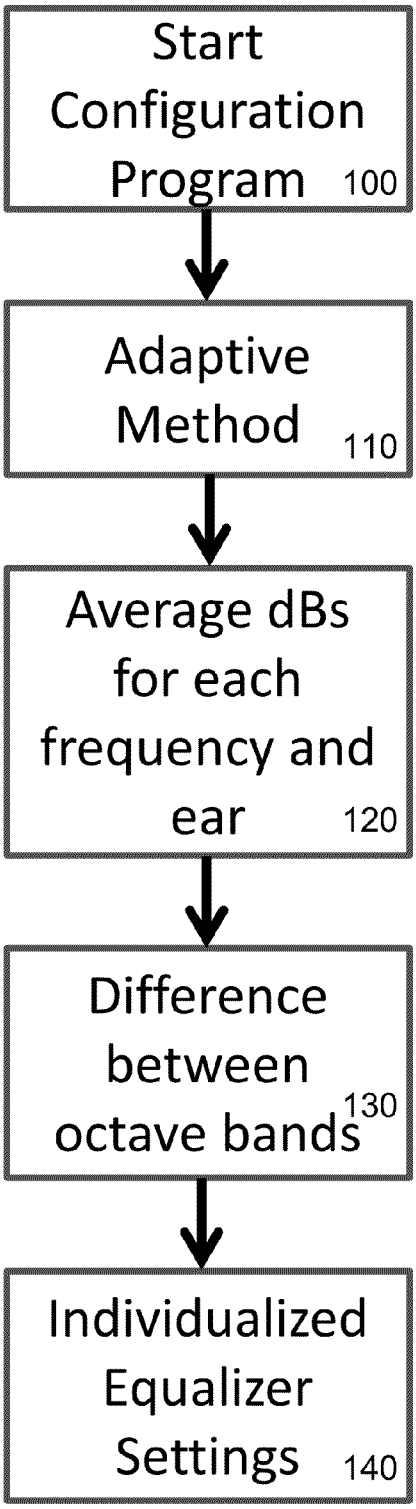
FIGS. 6-8 show diagrams of a configuration program or application in accordance with an exemplary embodiment of the present invention.
Figure 7:
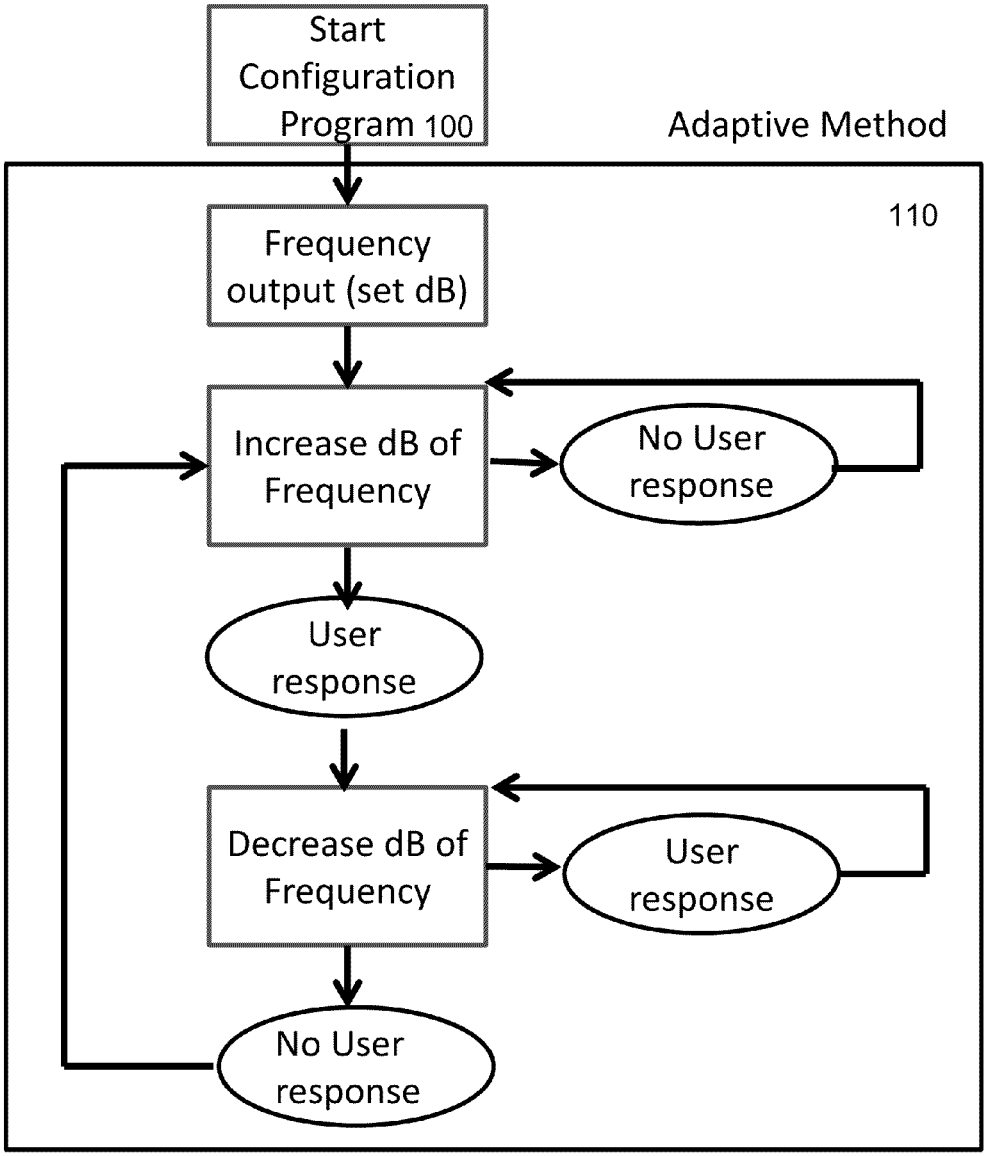

One exemplary method of manually adjusting equalizer settings for an earbud or earbuds (or similar devices) is shown in FIGS. 6 and 7. This method comprises a basic psychophysical method of measuring the user's threshold of hearing which is then used to set an individualized equalizer for the person with that particular set of headphones, earbuds, earphones, hearing aids, or the like, thereby obtaining the listener's unique frequency response curve. The user initiates the process by starting up the configuration program or application 100 (which may be available as a program or "app" on a smart phone, tablet computer, portable music device, or similar device). Alternatively, the process may be initiated through a control on an inline dongle, or the like. The program or application using an adaptive method 110 to determine the user's threshold of hearing. The program starts by playing a set frequency through one of the earbuds, earphones, or hearing aids, each frequency starting at a low intensity and gradually increasing until the user responds (such as by a button or key press) to indicate that he or she has heard the signal. At that point, the program decreases the intensity of the signal until the user stops indicating that they can hear the signal. These steps can be repeated several times for the same frequency to determine a mean (or average) intensity for that frequency for that particular ear 120. The process then is repeated at a different set frequency so as to eventually cover a range of frequency bands (i.e., center frequencies of the octave) for that ear. The entire process is then repeated for the other ear. It should be noted that the frequencies tested may be in different orders, and that testing of frequencies can alternate between ears. The difference 130 between the means (or averages) for the frequency bands is then used to set the equalizer for the frequency bands so as to the optimize the frequency response for the individual listener for that particular set of headphones, earbuds, earphones, or hearing aids.

This individualized equalizer setting 140 is saved for the user as a baseline setting. The user can subsequently modify this baseline setting in accordance with a number of preset modifications (e.g., rock, jazz, R&B, classical, and the like). In one embodiment, these preset modifications do not result in preset configurations that are identical for all users, but are preset modifications made to the individual's baseline setting, with the modifications made in accordance with the preset type. Thus, an individual's "rock" equalization setting for their left earbud may differ from the "rock" setting for their right earbud, and will differ from another individual's "rock" settings.

Figure 8:
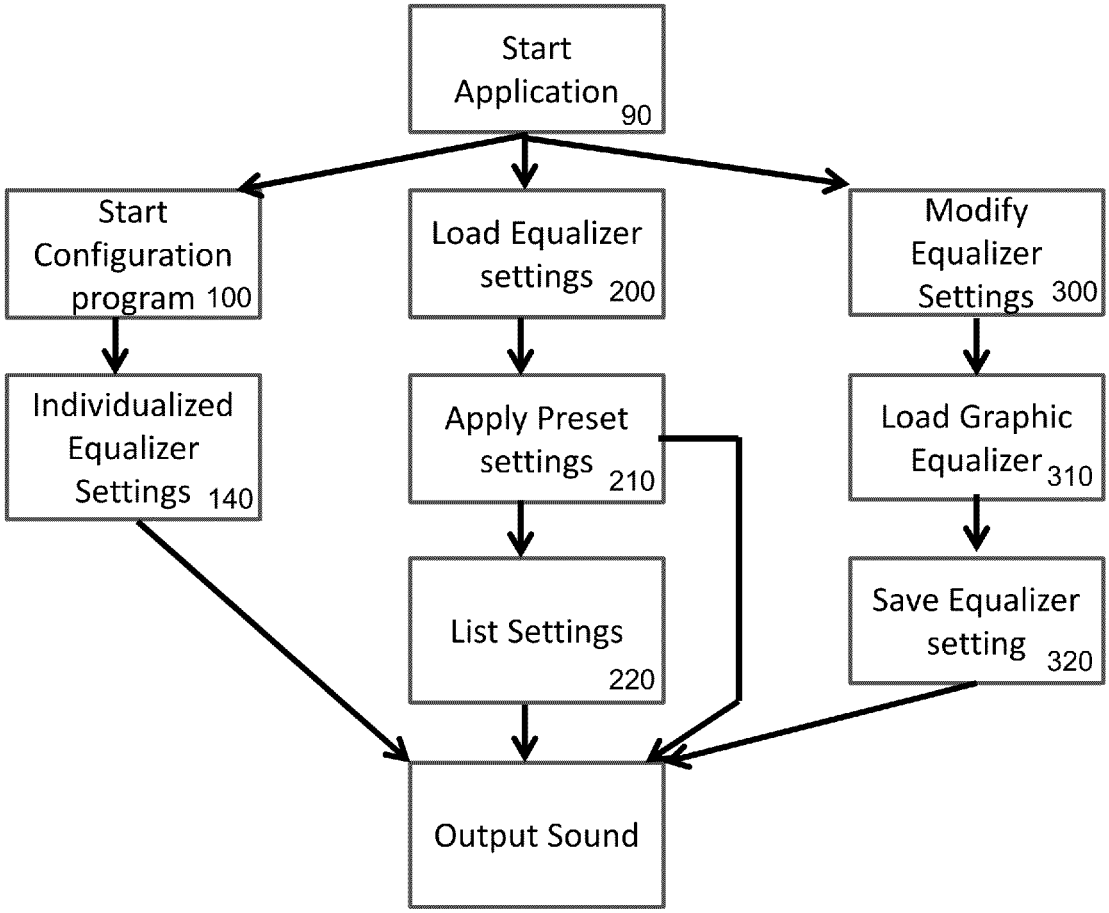

As seen in FIG. 8, these functions may be encompassed in a single program or application 90 operable on a smart phone, tablet, or other similar device as described above. The program can run the configuration program 100 to set individualized equalizer settings 140 as described above. The user can separately load these settings 200, and apply preset setting modifications 210 and/or list settings for review and application 220. The user also may manually modify the baseline equalizer setting 300, or any of other settings through a graphic equalizer on the device screen 310, and save those modified settings 320.

In another embodiment, the equalizer may have a number of established settings that can be chosen. The use may choose a desired setting for each earbud by a switch or controls on or attached to the earphone, or through a computer interface or device to which the earphone is connected (e.g., the earphone is plugged into a jack on the computer or device). Alternatively, where the equalizer actively adjusts itself as described above, it (or its control program or application) may automatically choose one of these settings based upon the reflection, rather than independently adjust particular bands.

In one embodiment, a pair of earphones may be provided as part of a set. Each earphone may have its own equalizer that can be individually adjusted. In another embodiment, a single equalizer may be used to adjust each of the earphones, but still separately (i.e., the user can switch between the right and left earphone while using the same equalizer control). In yet another embodiment, a single equalizer is used and those settings are used for both earphones. Where hearing aids or devices with a microphone are used, this permits the listener to receive the aural input and filter out white noise and other interfering frequencies and sounds (i.e., the device determines and compensates for ambient noise).

In yet another embodiment, earphones or hearing aids may be produced with preset equalizer settings for a particular type or configuration of ear. The user then purchases the appropriate earphone for his or her type (or types) of ear, but cannot adjust the equalizer setting.

Figure 9:
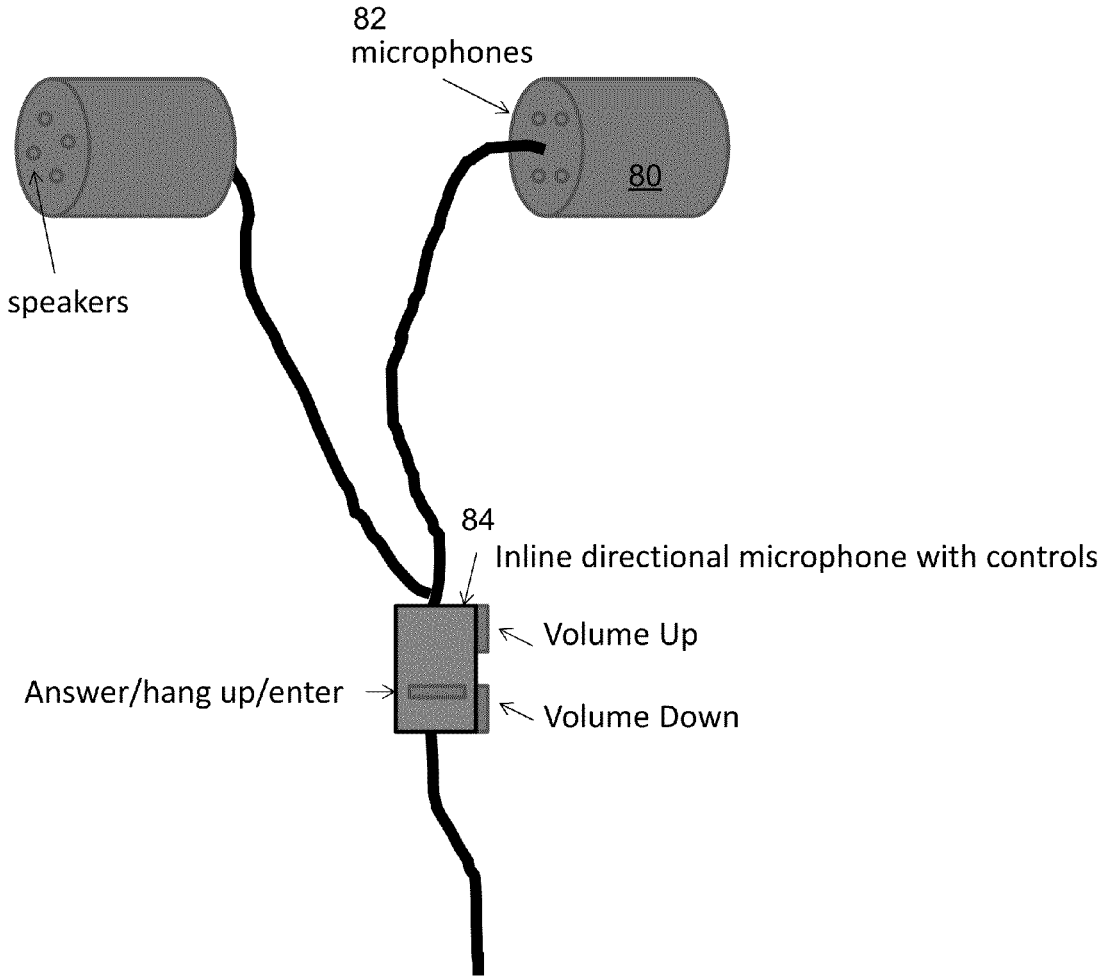
FIG. 9 shows a view of an earphone or hearing aid with microphones in accordance with another embodiment of the present invention.

As seen in FIG. 9, a further embodiment comprises one or more microphones 82 attached to or embedded in the earphones, earphones or hearing aids 80. The microphones enhance speech and can be used to filter environmental noise. An inline microphone or microphones 84 (i.e., a microphone on a control dongle in electronic communication with the earphones) can be used as directional microphones to enhance hearing from a particular source, to talk on a mobile phone, or the like. While a single microphone may be used, multiple microphones may be used to enhance sound localization in the free field.

Figure 10:
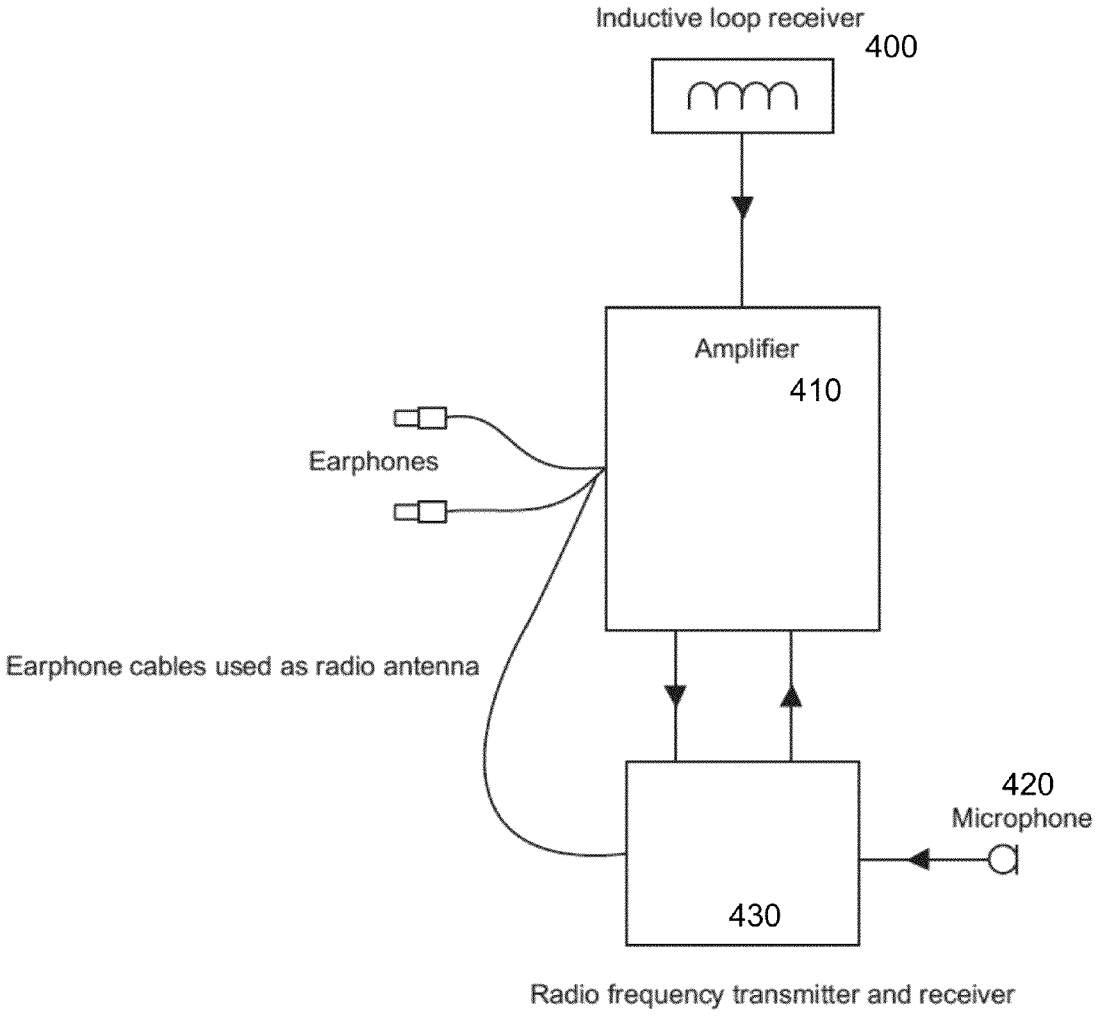
FIG. 10 shows a view of an earphone or hearing aid with an incorporated inductive loop receiver in accordance with another embodiment of the present invention.

In yet another embodiment, the earbuds, earphones or hearing aids as described above are used as part of a hearing telecoil or inductive loop, as seen in FIG. 10. Such loops are known in the prior art in public spaces, and the present invention can be adapted to pick up such transmissions. Loops can also be installed in private spaces, such as homes, automobiles, restaurants, bars, stores, and the like. In one embodiment, a loop may be made from the wires in the earphone or device cables.

As seen in FIG. 10, in one embodiment an inductive loop receiver 400 is connected to the earphone amplifier 410. The inductive loop receiver receives the audio signal from an inductive loop, such as a commercial inductive loop in a commercial area. The amplifier is connected to a radio frequency (RF) transmitter and receiver 430 with a microphone 420. The microphone in conjunction with the RF transmitter allows the transmission of local speech to a matching radio frequency receiver located at the inductive loop system transmitter, which in turn broadcasts said speed via the inductive loop system to all individuals in range who are equipped with the system. This allows individuals so equipped to talk to other individuals directly, using the RF receiver and transmitter as a two-way communication system. The microphone may be a highly-direction type of microphone in order to allow it to be aimed at a particular sound source, thereby improving intelligibility in noisy environments and reducing unwanted background noises. This is especially useful when using the system as a hearing aid.

Controls for the present invention may be contained in a smart phone device, in a dongle or similar apparatus connected to the earbuds or hearing aids, or in the device cables. Controls also may be wireless. In one embodiment, a user may switch between several input sources: e.g., the environment (as a hearing aid); a stereo or music source; a public loop; or other loops, in areas with multiple loops. In one embodiment, when used in conjunction with a microphone for the user, a number of individuals using the device can talk and listen to each other in a bar, club, stadium, arena, auditorium, classroom, movie theatre, or other space on a private loop, where the loop is created and maintained by their devices (i.e., a form of voice instant messaging).

In yet a further embodiment, pairs of earphones may be provided with processing circuitry or a program to create a three-dimensional or stereotactic effect, or other effects. In one embodiment, the processing involves the introduction of a time-delayed dither between two or more earphones, thereby simulating movement of the head during the listening process. The time-delay can be adjusted. In one exemplary embodiment, the processing provides both "near" and "far" settings, to simulate, for example, a sound source from within a room and from outside a room.

In another embodiment, the circuitry creates numerous, fast, saccadic shifts in the frequency of the signal to create a mental, three-dimensional effect in the sound. This is similar to the saccadic movement of human eyes. Humans, as well as many other animals, do not look at a visual scene in fixed steadiness. Instead, their eyes move around, locating noteworthy or interesting parts of the scene, thereby building up a mental, three-dimensional "map" corresponding to the visual scene. The movement of the eye allows smaller parts of a visual scene to be sensed with greater resolution. Saccades are the fastest movements produced by the human body. Saccades in response to an unexpected stimulus usually take approximately 200 milliseconds (ms) to initiate, and then last from about 20 to 200 ms, depending on their amplitude. Saccades during language reading typically last 20-30 ms.

In yet another embodiment, the earbuds or hearing aids may further comprise a variety of signal filters. In one embodiment, the filter is an apodizing filter to eliminate pre-echo or pre-ringing.

The above elements also may be applied to a set of external headphones or other hearing apparatus, with separate equalization and/or filtering and/or effect creation for each ear. Such a set of headphones provides more room to encompass the amplifier, equalizer, and/or power source.

It also should be noted that the above-described amplification, equalization, saccadic effect, and other processing can be performed on both digital and analog signals. The equalization and other techniques described above also may be applied to loudspeakers in music systems, home theatre systems, televisions, computers, and other devices.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A sound reproduction device, comprising:

two or more earbuds adapted to fit within a user's ears, wherein the signal output from each earbud is modified according to the geometry or configuration of the ear in which the earbud is placed, said geometry or configuration determined directly by reflection measurements;

wherein the signal output from the earbuds is modified by one or more equalizers;

further wherein a base equalization setting is established by determining the hearing threshold for a plurality of frequencies for each earbud-in association with a particular ear; and further wherein said hearing threshold determination is made for each earbud for each frequency by reproducing a sound at a low intensity and gradually increasing until the signal is audible, then lowering the intensity until the signal can no longer be heard.

2. The sound reproduction device of claim 1, wherein there are two earbuds in electronic communication with each other and a sound source.

3. The sound reproduction device of claim 1, wherein the signal output from each earbud is modified by a separate equalizer.

4. The sound reproduction device of claim 1, wherein the equalizer or equalizers comprises an inline equalizer.

5. The sound reproduction device of claim 1, wherein the equalizer or equalizers comprises an equalization program in a computing device.

6. The sound reproduction device of claim 1, wherein equalization is performed manually.

7. The sound reproduction device of claim 1, wherein equalization is performed automatically.

8. The sound reproduction device of claim 1, further comprising an amplifier.

9. The sound reproduction device of claim 1, wherein the amplifier is powered separately from a sound source.

10. The sound reproduction device of claim 1, wherein said one or more equalizers are adapted to self-adjust by sending an acoustic signal into the ear, and reading the reflection.

* * * * *